US010490198B2

(12) United States Patent
Kim et al.

(10) Patent No.: US 10,490,198 B2
(45) Date of Patent: Nov. 26, 2019

(54) DEVICE-SPECIFIC MULTI-CHANNEL DATA COMPRESSION NEURAL NETWORK

(71) Applicant: Google LLC, Mountain View, CA (US)

(72) Inventors: Chanwoo Kim, Mountain View, CA (US); Rajeev Conrad Nongpiur, Palo Alto, CA (US); Tara Sainath, Jersey City, NJ (US)

(73) Assignee: GOOGLE LLC, Mountain View, CA (US)

( * ) Notice: Subject to any disclaimer, the term of this patent is extended or adjusted under 35 U.S.C. 154(b) by 119 days.

(21) Appl. No.: 15/845,087

(22) Filed: Dec. 18, 2017

(65) Prior Publication Data

US 2018/0108363 A1 Apr. 19, 2018

Related U.S. Application Data

(63) Continuation of application No. 15/211,417, filed on Jul. 15, 2016, now Pat. No. 9,875,747.

(51) Int. Cl.

| | |
|---|---|
| ***G10L 19/00*** | (2013.01) |
| ***G10L 19/008*** | (2013.01) |
| *G10L 25/30* | (2013.01) |

(52) U.S. Cl.

CPC ..... *G10L 19/008* (2013.01); *G10L 19/0017* (2013.01); *G10L 25/30* (2013.01)

(58) Field of Classification Search

CPC ..... G10L 19/008; G10L 25/30
USPC ..... 704/202, 500
See application file for complete search history.

(56) References Cited

U.S. PATENT DOCUMENTS

| | | | | |
|---|---|---|---|---|
| 5,692,098 | A | 11/1997 | Kurdziel | |
| 5,737,485 | A | 4/1998 | Flanagan et al. | |
| 5,737,716 | A * | 4/1998 | Bergstrom | G10L 19/02 704/202 |
| 5,819,215 | A | 10/1998 | Dobson et al. | |
| 8,041,041 | B1 | 10/2011 | Luo et al. | |
| 8,332,229 | B2 | 12/2012 | Samsudin et al. | |
| 8,990,076 | B1 | 3/2015 | Strom | |
| 9,736,611 | B2 | 8/2017 | Hetherington et al. | |
| 2003/0016835 | A1 | 1/2003 | Elko et al. | |
| 2003/0097257 | A1 | 5/2003 | Amada et al. | |

(Continued)

OTHER PUBLICATIONS

Morishima, Shigeo, H. Harashima, and Y. Katayama. "Speech coding based on a multi-layer neural network." IEEE International Conference on Communications, Including Supercomm Technical Sessions. IEEE, 1990. (Year: 1990).*

(Continued)

*Primary Examiner* — Shaun Roberts
(74) *Attorney, Agent, or Firm* — Morris & Kamley LLP

(57) ABSTRACT

A sensor device may include a computing device in communication with multiple microphones. A neural network executing on the computing device may receive audio signals from each microphone. One microphone signal may serve as a reference signal. The neural network may extract differences in signal characteristics of the other microphone signals as compared to the reference signal. The neural network may combine these signal differences into a lossy compressed signal. The sensor device may transmit the lossy compressed signal and the lossless reference signal to a remote neural network executing in a cloud computing environment for decompression and sound recognition analysis.

10 Claims, 13 Drawing Sheets

(56) References Cited

U.S. PATENT DOCUMENTS

| | | | |
|---|---|---|---|
| 2004/0044520 | A1 | 3/2004 | Chen et al. |
| 2006/0031066 | A1 | 2/2006 | Hetherington et al. |
| 2011/0194704 | A1 | 8/2011 | Hetherington et al. |
| 2011/0224991 | A1 | 9/2011 | Fejzo et al. |
| 2012/0230497 | A1 | 9/2012 | Dressler et al. |
| 2014/0164001 | A1 | 6/2014 | Lang et al. |
| 2015/0095026 | A1 | 4/2015 | Bisani et al. |
| 2015/0340032 | A1 | 11/2015 | Gruenstein |
| 2016/0180838 | A1 | 6/2016 | Parada San Martin et al. |
| 2016/0379638 | A1 | 12/2016 | Basye et al. |

OTHER PUBLICATIONS

Disch, Sascha, Christian Ertel, Christof Faller, Juergen Herre, Johannes Hilpert, Andreas Hoelzer, Peter Kroon, Karsten Linzmeier, and Claus Spenger. "Spatial Audio Coding: Next-generation efficient and compatible coding of multi-channel audio." In Audio Engineering Society Convention 117. Audio Engineering Society, 2004.

Faller, Christof, and Frank Baumgarte. "Binaural cue coding applied to stereo and multi-channel audio compression." In Audio Engineering Society Convention 112. Audio Engineering Society, 2002.

Olah, Chris, "Understanding LSTM Networks." In Colah's Blog, 2015. http://colah. github.io/posts/2015-08-Understanding-LSTMs/ (last visited Jul 5, 2016).

Sainath, Tara N., Ron J. Weiss, Andrew Senior, Kevin W. Wilson, and Oriol Vinyals. "Learning the speech front-end with raw waveform cldnns." In Proc. Interspeech. 2015.

Sainath, Tara N., Ron J. Weiss, Kevin W. Wilson, Arun Narayanan, and Michiel Bacchiani. "Factored spatial and spectral multichannel raw waveform CLDNNs." In 2016 IEEE International Conference on Acoustics, Speech and Signal Processing (ICASSP), pp. 5075-5079. IEEE, 2016.

* cited by examiner

DEVICE-SPECIFIC MULTI-CHANNEL DATA COMPRESSION NEURAL NETWORK

BACKGROUND

The accuracy of signal analysis systems can directly depend on the amount of information contained in the signals being analyzed. Thus signals may be transmitted to analysis components in file formats having a large file size. These large file sizes may demand high quantities of bandwidth and subject the signals to increased risk of interruption when transmitted over networks.

SUMMARY

In accordance with an implementation of this disclosure, at least a first neural network layer of a first neural network of a first device may determine a first signal difference between a signal characteristic of a first audio signal and a signal characteristic of a second audio signal. At least a second neural network layer of the neural network may compress the first audio signal and the second audio signal into a third audio signal based on the first signal difference. The first device may provide, to a second device, the first audio signal and the third audio signal.

In accordance with an implementation of this disclosure, a non-transitory, computer-readable medium may store instructions that, when executed by a processor, cause the processor to perform operations. The operations may include determining by at least a first neural network layer of a neural network of a first device, a first signal difference between a signal characteristic of a first audio signal and a signal characteristic of a second audio signal. The operations may include compressing, by at least a second neural network layer of the neural network and based on the first signal difference, the first audio signal and the second audio signal into a third audio signal. The operations may include providing, by the first device to a second device, the first audio signal and the third audio signal.

In accordance with an implementation of this disclosure, a first device may include a processor and a non-transitory, computer-readable medium in communication with the processor and storing instructions that, when executed by the processor, cause the processor to perform operations. The operations may include determining, by at least a first neural network layer of a neural network of a first device, a first signal difference between a signal characteristic of a first audio signal and a signal characteristic of a second audio signal. The operations may include compressing, by at least a second neural network layer of the neural network and based on the first signal difference, the first audio signal and the second audio signal into a third audio signal. The operations may include providing, to a second device, the first audio signal and the third audio signal.

In accordance with an implementation of this disclosure a means may be provided for determining by at least a first neural network layer of a neural network, a first signal difference between a signal characteristic of a first audio signal and a signal characteristic of a second audio signal. The means may provide for compressing, by at least a second neural network layer of the neural network and based on the first signal difference, the first audio signal and the second audio signal into a third audio signal. The means may provide for providing, to a second device, the first audio signal and the third audio signal.

In accordance with an implementation of this disclosure a first device may generate, based on a first audio signal and a second audio signal, a third audio signal. At least a first neural network layer of a neural network of the first device may determine a first signal difference between a signal characteristic of the first audio signal and a signal characteristic of the third audio signal. At least the first neural network layer may determine a second signal difference between a signal characteristic of the second audio signal and a signal characteristic of the third audio signal. At least a second neural network layer of the neural network may compress the first audio signal and the second audio signal into a fourth audio signal based on the first signal difference and the second signal difference. The first device may provide the third audio signal and the fourth audio signal to a second device.

In accordance with an implementation of this disclosure, a non-transitory, computer-readable medium may store instructions that, when executed by a processor, cause the processor to perform operations. The operations may include generating, by a first device based on a first audio signal and a second audio signal, a third audio signal. The operations may include determining, by at least a first neural network layer of a neural network of the first device, a first signal difference between a signal characteristic of the first audio signal and a signal characteristic of the third audio signal. The operations may include determining, by at least the first neural network layer of the neural network, a second signal difference between a signal characteristic of the second audio signal and a signal characteristic of the third audio signal. The operations may include compressing, by at least a second neural network layer of the neural network based on the first signal difference and the second signal difference, the first audio signal and the second audio signal into a fourth audio signal. The operations may include providing, by the first device to a second device, the third audio signal and the fourth audio signal.

In accordance with an implementation of this disclosure, a means may be provided for generating, based on a first audio signal and a second audio signal, a third audio signal. The means may provide for determining, by at least a first neural network layer of a neural network, a first signal difference between a signal characteristic of the first audio signal and a signal characteristic of the third audio signal. The means may provide for determining, by at least the first neural network layer, a second signal difference between a signal characteristic of the second audio signal and a signal characteristic of the third audio signal. The means may provide for compressing, by at least a second neural network layer of the neural network based on the first signal difference and the second signal difference, the first audio signal and the second audio signal into a fourth audio signal. The means may provide for providing, to a second device, the third audio signal and the fourth audio signal.

In accordance with an implementation of this disclosure, a first neural network executing on one or more first computing devices may determine multiple signal differences between one or more signal characteristics of a first audio signal of a first set of audio signals and one or more signal characteristics of one or more other audio signals of the first set of audio signals. The first neural network may compress the first set of audio signals into a compressed audio signal based on the multiple signal differences. The one or more first computing devices may provide the first audio signal and the compressed audio signal to a second neural network executing on one or more second computing devices. The first neural network may receive a second set of audio signals from the second neural network. The second set of audio signals may have been decompressed by the second neural network from the first audio signal and the compressed audio signal. The one or more computing devices may compare the first set of audio signals to the second set of audio signals and train the first neural network based on the comparison.

In accordance with an implementation of this disclosure, a means may be provided for determining, by a first neural network, a set of signal differences between one or more signal characteristics of a first audio signal of a first set of audio signals and one or more signal characteristics of one or more other audio signals of the first set of audio signals. The means may provide for compressing, by the first neural network and based on the set of signal differences, the first set of audio signals into a compressed audio signal. The means may provide for providing, the first audio signal and the compressed audio signal to a second neural network executing on one or more second computing devices. The means may provide for receiving, by the first neural network from the second neural network, a second set of audio signals decompressed by the second neural network from the first audio signal and the compressed audio signal. The means may provide for comparing the first set of audio signals to the second set of audio signals and training the first neural network based on the comparison.

Features, advantages, implementations, and embodiments of the disclosure may be apparent from consideration of the following detailed description, drawings, and claims. Moreover, it is to be understood that both the foregoing summary and the following detailed description are illustrative and are intended to provide further explanation without limiting the scope of the claims.

BRIEF DESCRIPTION OF THE DRAWINGS

The accompanying drawings, which are included to provide further understanding of this disclosure, are incorporated in and constitute a part of this specification. The drawings also illustrate implementations and/or embodiments of the disclosure, and together with the detailed description serve to explain the principles of implementations and/or embodiments of the disclosure. No attempt is made to show structural details in more detail than may be necessary for a fundamental understanding of the disclosure and various ways in which it may be practiced.

DETAILED DESCRIPTION

Figure 1:
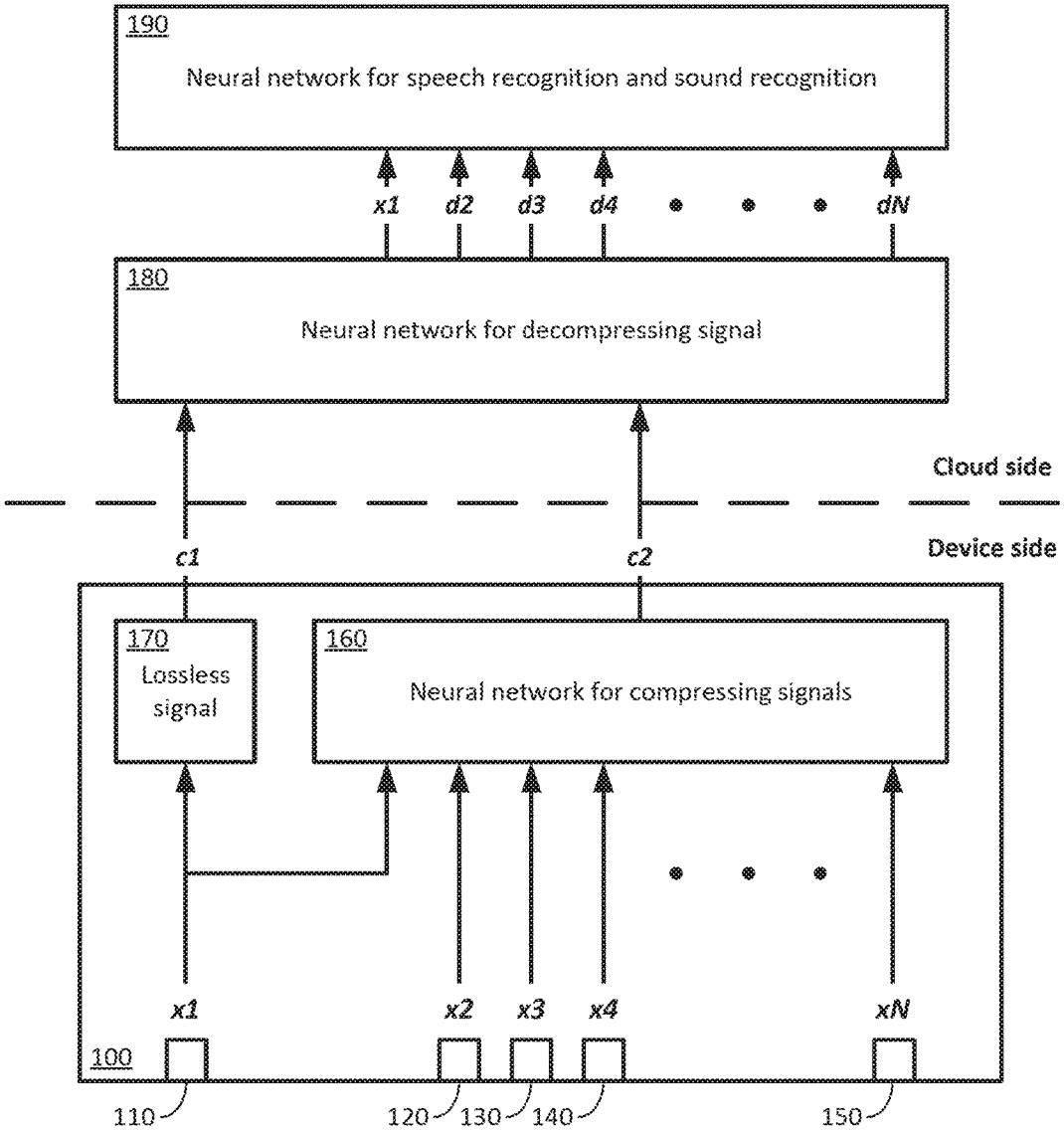
FIG. 1 shows a system diagram of components for compressing and decompressing signals according to an implementation of this disclosure.

In an implementation of this disclosure, a sensor device may execute a neural network that compresses audio signals from multiple signal sources, such as microphones, into a lower bit rate signal for more efficient and robust network transmission. For example, a sensor device in a "smart home environment" as described below may have five different microphones and may be positioned in a room of a home. An event in the home may generate sound waves that interact with each of the microphones and cause each to generate a signal. Each of these signals may often be quite similar to the other because they each may be caused by the same event. As a result, in some instances, only relatively minor differences in signal characteristics amongst the signals may need to be encoded in order to effectively approximate the signals at a later time. One of the microphone signals may be designated as a reference signal, and the other microphone signals may be designated as secondary signals. Each secondary signal may have differences in signal characteristics as compared to the reference signal. The signal differences may be, for example, differences in phase, magnitude, gain, frequency response, or a transfer function representing the relationship between the input and output of a respective signal source. These signal differences may be caused, for example by the different positions of the microphones on the housing of the device or the different geometry of the surfaces of the room with respect to each microphone.

The sensor device may contain a computing device executing a first neutral network. The first neural network may be trained to extract the significant differences between signal characteristics of the reference signal and signal characteristics of the secondary signals. The first neural network may generate a compressed signal by combining these extracted signal differences. The compressed signal may be a lossy signal, having a lower bit rate than any of the secondary signals or the sum of the bit rates of the secondary signals from which the signal differences were extracted. The sensor device may losslessly compress the reference signal and transmit the compressed lossless reference signal along with the compressed lossy signal to a network of distributed computing devices in a cloud computing environment.

A second neural network trained to decompress the compressed lossy signal may execute on the distributed computing devices in the cloud environment. One of the computing devices in the cloud environment may decompress the compressed lossless reference signal into the original reference signal. The second neural network may process the decompressed reference signal and the compressed lossy signal into representations of the secondary signals. The original reference signal and the representations of the secondary signals may be transmitted to a third neural network executing on computing devices in the cloud environment.

The third neural network may be trained to identify speech or sounds in received audio signals. The third neural network may receive the original reference signal and representations of the secondary signals and may perform sound recognition procedures, such as automated speech recognition, to identify words or sounds of interest. Indicators of these words or sounds may be transmitted back to the sensor device and serve as a basis for further functionality. For example, recognized speech may trigger the functioning of a system in the smart home environment such as air conditioning, lighting, or audio/video systems, or recognized sounds may trigger alerts on systems such as child monitoring systems or security systems. For example, the recognition of the sound of broken glass may serve as the basis for triggering a home alarm, or the recognition of the cry of a child may serve as the basis for notifying a parent that the child needs attending.

Generally, embodiments and implementations of this disclosure may be partially or completely incorporated within a smart home environment, such as is described in later portions of this disclosure. The smart home environment may include systems such as premises management systems that may include or communicate with various intelligent, multi-sensing, network-connected devices, such as the neural network executing sensor device described above. Devices included within the smart home environment, such as any of the sensor devices and related components described below with respect to FIGS. 9A-13, may integrate seamlessly with each other and/or with a central server or cloud-computing system. By incorporating and/or communicating with such components, the smart home environment may provide home automation and related functionality. For example, premises management systems may provide functionality such as home security, temperature control, lighting control, sound control, home appliance control, entertainment system control, home robot control, fire detection and suppression, hazardous substance detection and suppression, health monitoring, sleep monitoring, pet and plant management, or any other functionality suitable for the purposes of this disclosure.

In an embodiment of this disclosure, multiple microphones of a sensor device may detect sound waves and generate audio signals from those sound waves. For example, FIG. 1 shows a system diagram of components for compressing and decompressing signals according to an implementation of this disclosure. Device 100 may include multiple signal sources 110-150 such as microphones. Microphones 110-150 may include any set of components suitable for converting mechanical sound waves into electrical signals. For example, microphones 110-150 may include condenser, dynamic, ribbon, carbon, piezoelectric, fiber optic, or microelectrical-mechanical system microphones. Embodiments of this disclosure may include two, three, four, eight, or more microphones. Microphones 110-150 may be located on multiple faces of a housing of sensor device 100. For example, device 100 may be installed on the ceiling of a room in the home. The housing of device 100 may have five faces, each directed at different portions of the room and each with a separate microphone integrated into the face of the housing.

When microphones 110-150 receive sound waves, transducers housed within microphones 110-150 may generate signals, such as audio signals x1-xN. Device 100 may include signal channels composed of electronic circuitry suitable to communicate signals x1-xN to a computing device. The computing device may be any of those discussed below with respect to FIGS. 9A-13, and may include a processor and a non-transitory, computer-readable storage medium, such as solid state memory. The computing device may be contained within device 100 or remote from the device and in communication with microphones 110-150 via a wired connection or via a wireless network connection. The computing device may include any of various components suitable for communication with other computing devices and other components of the smart home environment, such as network interfaces, transmitters or receivers configured to operate in accordance with network protocols, digital encoders, and so forth.

The non-transitory, computer readable storage medium many store instructions for executing neural network 160 that compresses signals x1-xN for further transmission. Neural network 160 may be any of various types of neural networks suitable for the purposes of this disclosure. For example, in some implementations, neural network 160 may be a deep neural network that includes multiple neural network layers. In some implementations, in addition or as alternatives to a deep neural network, the neural network may include one or more recurrent neural network layers such as long short-term memory layers, one or more convolutional neural network layers, or one or more local contrast normalization layers. Neural networks, as described herein, may also have the architecture of a convolutional, long short-term memory, fully connected deep neural network. In some instances, various types of filters such as infinite impulse response filters, linear predictive filters, Kalman filters, or the like may be implemented in addition to or as part of one or more of the neural network layers.

Figure 2:
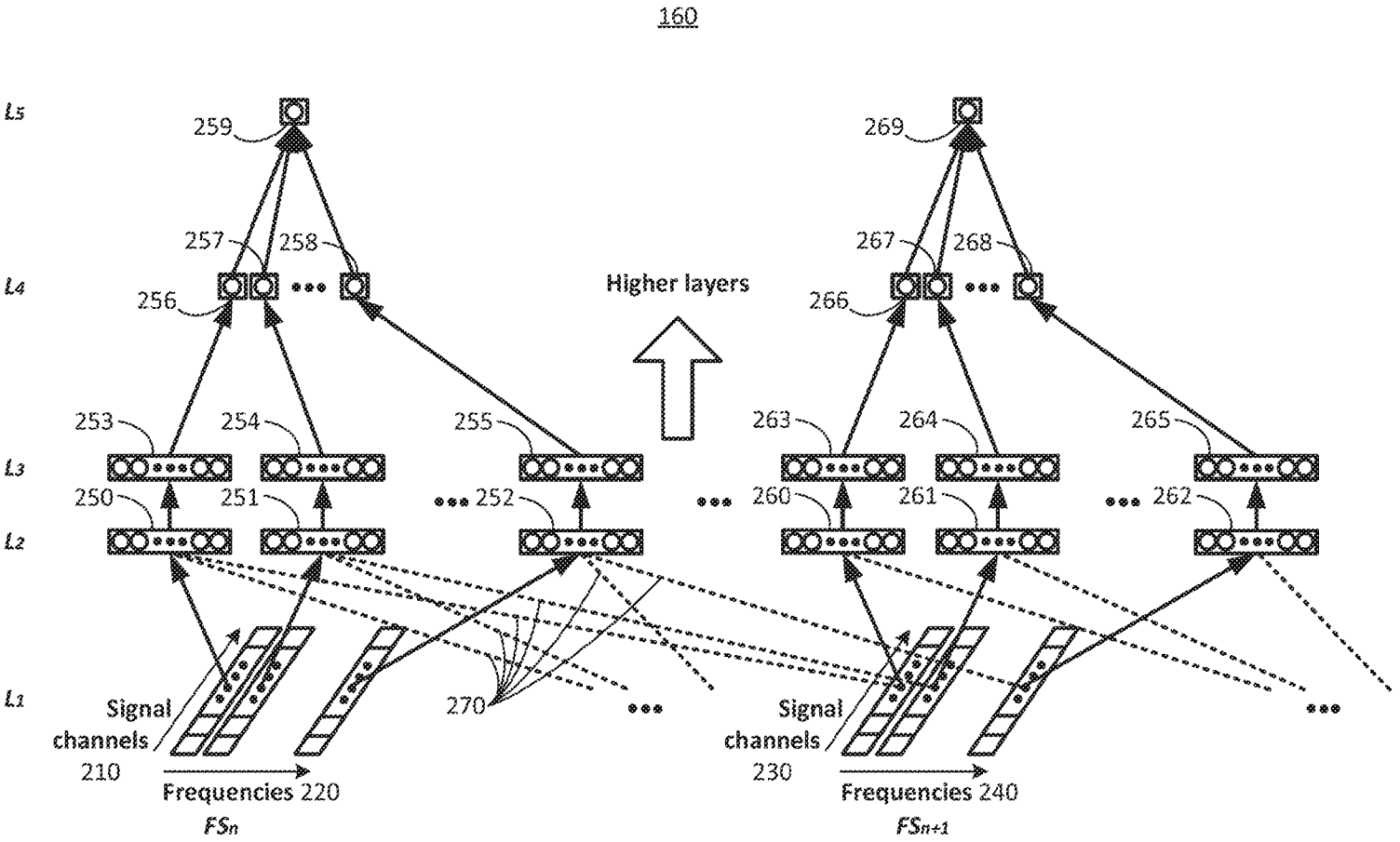
FIG. 2 shows a system diagram of a neural network according to an implementation of this disclosure.

FIG. 2 shows a system diagram of neural network 160 according to an implementation of this disclosure. Neural network 160 may include multiple trained neural network layers $L_1$, $L_2$, $L_3$, $L_4$, $L_5$ for extracting differences amongst signal characteristics of received audio signals. Neural network layers $L_1$, $L_2$, $L_3$, $L_4$, $L_5$ may be further trained to compress the received audio signals by combing the extracted signal differences into a new audio signal. Neural network 160 may have any quantity of layers suitable for the purposes of this disclosure. For example neural network 160 may have two or three layers.

As shown in FIG. 2, two frequency spectra, $FS_n$ and $FS_{n+1}$, may be inputs to neural network 160 at layer $L_1$. Over a given length of time, audio signals may be represented as multiple frequency spectra. For example, frequency spectrum $FS_{n+1}$ may be received by neural network 160 at a later time than frequency spectrum $FS_n$. Frequency spectrum $FS_n$, may include signal channels 210 representing audio inputs from multiple microphones of device 100 and signal characteristics such as the set of frequencies 220 for each signal channel. Similarly, frequency spectrum $FS_{n+1}$, may include signal channels 230 representing audio inputs from multiple microphones of device 100 and the set of frequencies 240 for each signal channel. Additional signal characteristics for each signal channel may be included in layer $L_1$ such as phase, magnitude, gain, frequency response, and transfer function(s).

In some implementations, digitized samples of audio signals received from the microphones may be convolved with finite-duration impulse response filters of prescribed lengths. Since the input features to a neural network may generally be frequency-domain based representations of the signals, modeling the finite-duration impulse response filter within the neural network may be relatively straightforward in the frequency domain. Modeling the finite-duration impulse response filter response in the frequency domain may require that the parameters corresponding to the finite-duration impulse response filter be complex numbers, however. Thus additional non-linear post-processing may occur, for example, by enhancing signals in one spectrum or suppressing signals in another spectrum. This post-processing may be applied to the signals in the frequency domain.

In an implementation of this disclosure for frequency spectrum $FS_n$, higher layers of neural network 160 may include nodes 250, 251, 252 for layer $L_2$; nodes 253, 254, 255 for layer $L_3$; nodes 256, 257, 258 for layer $L_4$; and node 259 in highest layer $L_5$. Similarly for frequency spectrum $FS_{n+1}$, higher layers of neural network 160 may include nodes 260, 261, 262 for layer $L_2$; nodes 263, 264, 265 for layer $L_3$; nodes 266, 267, 268 for layer $L_4$; and node 269 in highest layer $L_5$. Nodes may be computational elements of neural network 160. A node may be adaptively weighted, in accordance with its relationship to other nodes and include threshold values or implement other suitable functions that affect output of the node. Nodes may preform real or complex computations, such as operations involving the phase and magnitude of an input signal.

In implementations of this disclosure, layers between and/or including the highest or lowest layer of neural network 160 may be trained to extract differences in signal characteristics received via signal channels 210, 230. For example, nodes 250-258 of layers $L_2$, $L_3$, and $L_4$ of frequency spectrum $FS_n$ may compare signal characteristics of signals received from signal channels 210 to a reference signal. Similarly, nodes 260-268 of layers $L_2$, $L_3$, and $L_4$ of frequency spectrum $FS_{n+1}$ may compare signal characteristics of signals received from signal channels 210 to a reference signal. Through neural network processing, $L_2$, $L_3$, and $L_4$ may extract significant differences in the signal characteristics, such as differences in frequency, phase, magnitude, frequency response, or transfer function. For example, one or more of nodes 250-258 and 260-268 may be weighted as a result of training neural network 160 to generate a beneficial compressed signal. The nodes of trained layers $L_2$, $L_3$, and $L_4$ may then exact differences in signal characteristics that are determined to positively contribute to forming the beneficial compressed signal. These signal differences may be combined in higher layers of neural network 160 to generate a beneficial compressed lossy signal.

Neural network 160 may also capture temporal relationships according to implementations of this disclosure. For example, the outputs from the surrounding past and future samples of a given frequency spectrum may be combined from various signal channels to form a convolutional neural network. For example, the temporal relationships between the frequency spectra may be captured from layers $L_1$ to $L_2$, as illustrated by dashed lines 270 between different time instances of the frequency spectra $FS_n$, $FS_{n+1}$.

In implementations of this disclosure, neural network 160 may pass the extracted significant differences in signal characteristics to layer $L_5$. Layer $L_5$ may be the highest layer of neural network 160 and may have fewer nodes than lower layers $L_1$-$L_4$. For example layer $L_5$ of frequency spectrum $FS_n$ may have a single node 259, and layer $L_5$ of frequency spectrum $FS_{n+1}$ may have a single node 269. The highest layer of neural network 160 may function as a linear bottleneck layer, where signal characteristic data received from multiple lower level nodes may be compressed into a signal having a higher data compression ratio. The highest layer of a neural network may be the layer of the neural network where no other layer exists between the highest layer and the output of the neural network. The new compressed signal may be considered to be a lossy signal because it does not contain all of the data of signal channels 210. Thus, for example, data representing significant differences in signal characteristics extracted by layers $L_2$, $L_3$, and $L_4$ of frequency spectrum $FS_n$ of neural network 160 may be passed via multiple nodes 256, 257, and 258 of layer $L_4$ to the single node 259 of layer $L_5$ and compressed into a signal having a higher data compression ratio. Similarly, data representing significant differences in signal characteristics extracted by layers $L_2$, $L_3$, and $L_4$ of frequency spectrum $FS_{n+1}$ may be passed via multiple nodes 266, 267, and 268 of layer $L_4$ to the single node 269 of layer $L_5$ and compressed into a signal having a higher data compression ratio.

Figure 3:
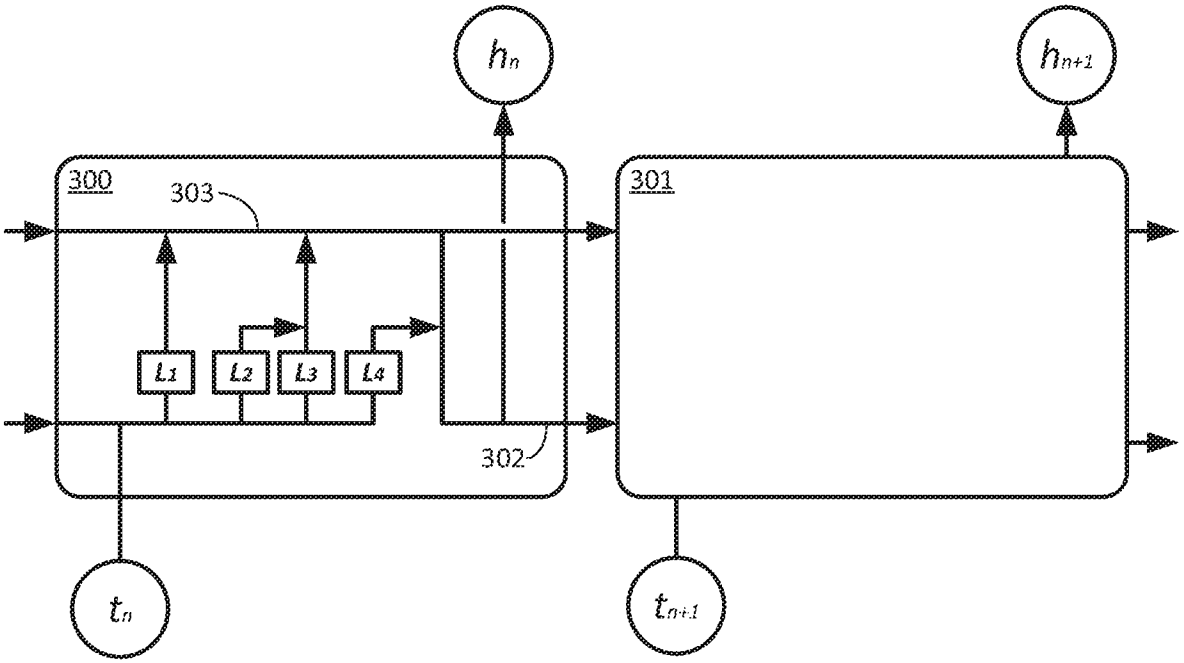
FIG. 3 shows a memory cell of a neural network according to an implementation of this disclosure.

In some implementations, neural network 160 may have fewer layers or alternate structures. For example, FIG. 3 shows a memory cells 300, 301 of a long, short-term memory neural network at time $t_n$ and at a later time $t_{n+1}$. Memory cells 300, 301 may represent the state of a neural network at a given time and may include interactions amongst multiple layers of the neural network. For example, layers $L_1$, $L_2$, $L_3$, and $L_4$ are shown interacting at time $t_n$ in memory cell 300. Memory cells may depict the output of the neural network existing in a given state. For example, memory cell 300 may output $h_n$ at time $t_n$ and memory cell 301 may output $h_{n+1}$ at later time $t_{n+1}$. Long, short-term memory neural networks may be a type of recurrent neural network where output from the neural network influences future states of the neural network. For example, outputs 302, 303 may be passed back to the neural network, such as is depicted by the connection of outputs 302, 303 to a future state of the neural network represented by memory cell 301.

Output 303 may represent a cell state of the neural network. The cell state may connect each memory cell of the neural network. Interactions between the rest of the neural network and the cell state may be regulated by gates such that information flow may be selectively restricted from adding to or leaving the cell state. Gates may be composed of a neural network layer, such as $L_3$ and a pointwise multiplication operation. By only selectively allowing the cell state to change, long short-term memory neural networks may maintain long-term dependencies on certain information learned by the neural network in the past. Output 302 may represent the loop generally found in recurrent neural networks that is not selectively gated in the same way as the cell state of output 303. Further discussion and examples of long, short-term memory neural networks as well as the basis for FIG. 3 itself are shown and discussed in Chris Olah, Understanding LSTM Networks, Colah's Blog (2015), http://colah.github.io/posts/2015-08-Understanding-LSTMs/ (last visited Jul. 5, 2016).

As shown in FIG. 1, signal sources 110-150 may each provide a signal x1-xN to neural network 160. A particular signal source may be selected to provide the reference signal. Neural network 160 may then use the reference signal as a basis for comparison when determining significant differences amongst signal characteristics of the remaining signals. As show, signal x1 may be the reference signal. Signal x1 may also be provided to signal encoder 170. Signal encoder 170 may be any combination of hardware and/or software suitable to encode signal x1 in a lossless compression format. For example, encoder 170 may be a set of instruction stored in a non-transitory, computer readable medium of the computing device of sensor device 100 for executing a procedure to compress data that allows original data to be perfectly reconstructed in uncompressed format. Examples of lossless compression procedures may include the Free Lossless Audio Codec, DOLBY® TrueHD, Audio Lossless Coding, DTS-HD Master Audio, MPEG-4, APPLE® Lossless Audio Codec, and WINDOWS® Media Audio Lossless. Encoder 170 may receive reference signal x1 and losslessly encode the signal into compressed signal c1 prior to transmission to computing components for decompression along with the compressed lossy signal c2. In some implementations, signal x1 may not be compressed and instead be transmitted at the bit rate it was originally generated at by signal source 110. For example uncompressed c1 may be a raw waveform. In another example decompression of losslessly compressed c1 may also result in a raw wave form.

Figure 4:
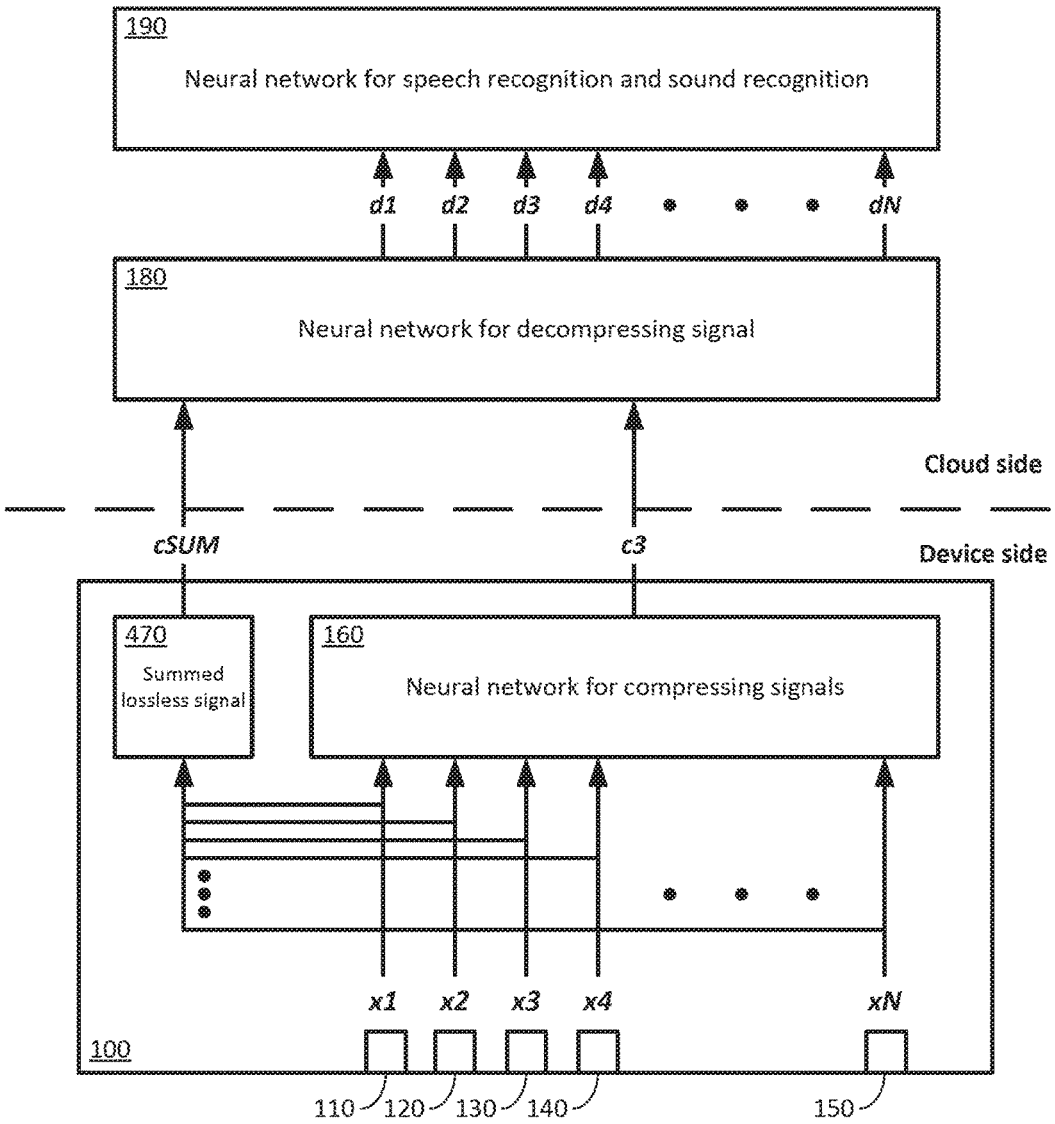
FIG. 4 shows a system diagram of components for compressing and decompressing signals according to an implementation of this disclosure.

In other implementations, the reference signal may be a composite of signals from signal sources 110-150. For example, FIG. 4 shows system diagram of components for compressing and decompressing signals according to an implementation of this disclosure. As shown, a lossessly compressed signal may be generated by encoder 470 which may receive each source signal x1-xN and sum the source signals to generate the reference signal, SUM. Reference signal, SUM, may be losslessly compressed by encoding component 470, in any manner as previously described with respect to encoder 170 to generate losslessly compressed signal cSUM. Similarly to the above, neural network 160 may extract significant differences from signal characteristics of secondary signals as compared to the reference signal, SUM. Neural network 160 may combine the extracted differences into compressed signal, c3. In other implementations, an average of source signals x1-xN may be calculated by encoder 470 and used as the reference signal to serve as the basis for comparison in a similar manner as the SUM signal.

Figure 5:
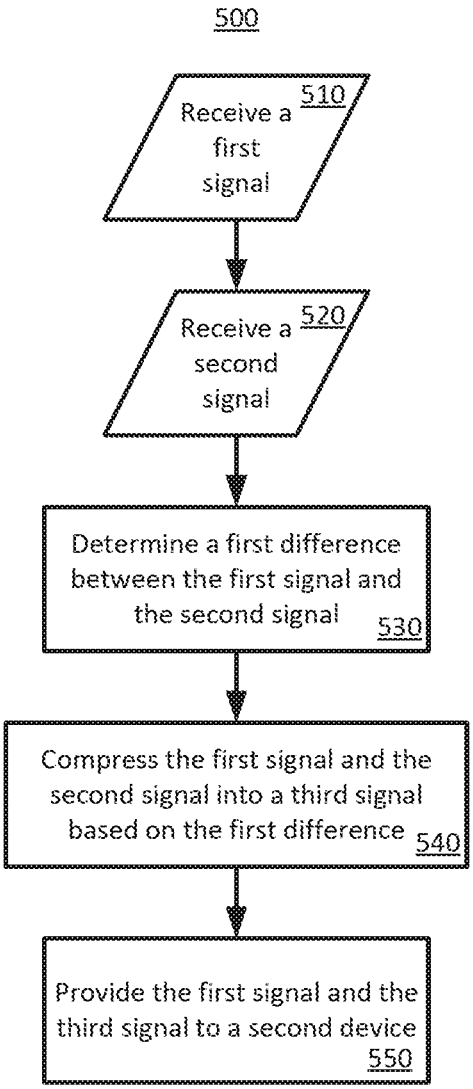
FIG. 5 shows a procedure for compressing audio signals by a neural network in accordance with an implementation of this disclose.

Various procedures may be executed to compress source signals prior to transmission. For example, FIG. 5 shows a procedure 500 for compressing audio signals by a neural network in accordance with an implementation of this disclose. At 510 a first computing device, such as may be found in sensor device 100, may receive a first audio signal, such as reference signal x1 shown in FIG. 1, from a first audio signal source, such as microphone 110. The first computing device may compress the first audio signal into a lossless format. At 520 the first computing device may receive one or more second audio signals, such as secondary audio signal x2, from a second audio signal source, such as microphone 120. At least a first neural network layer of a neural network executing on the first computing device may receive each signal and determine a first signal difference between a signal characteristic of the first audio signal and a signal characteristic of the second audio signal at 530. Multiple additional audio signals may be received and multiple additional signal differences in signal characteristics may be determined in a similar manner.

The first neural network layer may determine many differences between signal characteristics of the first audio signal and signal characteristics of the second audio signal. However, only some of the determined differences may be selected. For example, nodes of the first neural network layer as well as other layers may be weighted or otherwise trained such that only nodes that extract differences in signal characteristics that are above a threshold value are passed to higher layers of the neural network. As another example, only certain components of a signal difference may be valuable for signal compression. Thus, for example, nodes of the first neural network layer may be weighted such that certain valuable frequency differences are passed to higher layers or amplified, and other frequency differences are restricted or their contributing effects degraded.

At 540, at least a second neural network layer of the neural network may compress the first audio signal and the second audio signal into a third compressed audio signal based on the first signal difference. The second neural network layer may be distinct from the first neural network layer. For example, the second neural network layer may be the highest layer in the neural network, and the first neural network layer may be one of the lower neural network layers. The at least second neural network layer may compress the first audio signal and the second audio signal into a lossy compressed third signal, and a bit rate of the first signal may be greater than a bit rate of the third signal. The first computing device may then provide the third audio signal and the first audio signal to a second computing device at 550 for decompression and further processing. The second computing device may be distinct and remote from the first computing device. For example the first computing device may be within a sensor device, such as sensor device 100 and located in a home, and the second computing device may be one of multiple servers in a remote cloud computing environment.

Figure 6:
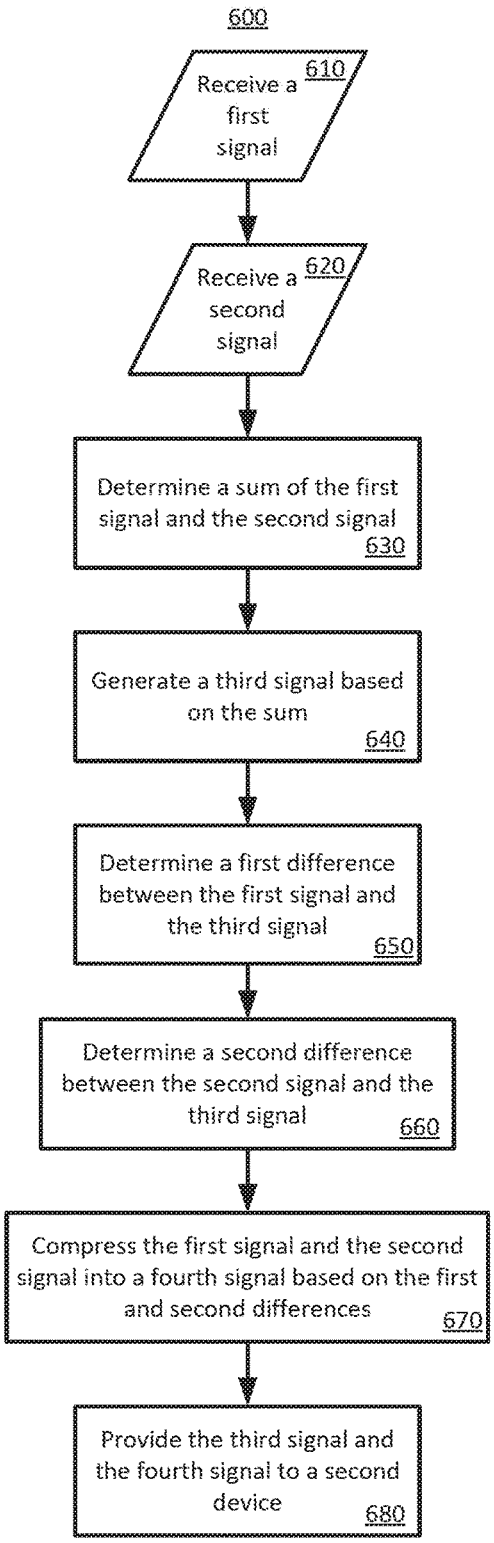
FIG. 6 shows a procedure for compressing audio signals by a neural network according to an implementation of this disclosure.

In another example, FIG. 6 shows a procedure 600 for compressing audio signals by a neural network in accordance with an implementation of this disclosure. At 610 a first computing device, such as may be found in sensor device 100, may receive a first audio signal from a first audio signal source, and at 620, the first computing device may receive a second audio signal from a second audio signal source. At 630 the first computing device may generate a third audio signal based on the first audio signal and the second audio signal. For example, the first computing device may calculate a sum or mean of one or more signal characteristics of the first audio signal and one or more signal characteristics of the second audio signal. The first computing device may then output this calculation as a third signal. At 650 at least a first neural network layer of a neural network executing on the first computing device may determine a first signal difference between a signal characteristic of the first audio signal and a signal characteristic of the third audio signal. For example the first neural network layer may calculate a difference between a signal characteristic, such as gain or phase, of the first audio signal and the calculated mean gain or mean phase of the first audio signal and the second audio signal. As another example, the first computing device, either through the neural network or through other processing techniques may normalize the first signal difference against other calculated signal differences.

At 660 at least the first neural network layer may determine a second signal difference between a signal characteristic of the second audio signal and a signal characteristic of the third audio signal. At least a second neural network layer of the neural network may then compress the first audio signal and the second audio signal into a fourth audio signal based on the first signal difference and the second signal difference at 670. At 680 the first computing device may provide the third signal and the fourth signal to a second computing device for decompression and further processing.

A reference signal and compressed signal may be provided to one or more second computing devices for decompression. For example, as shown in FIGS. 1 and 4, both the reference signal and the compressed signal may be provided to one more computing devices executing neural network 180 in a cloud computing environment. In some embodiments the one or more second computing devices may be local to the first computing device or include the first computing device. Decompression neural network 180 may include any of the neural network structures discussed above with respect to neural network 170. In some implementations, neural network 180 may have a lowest layer with a single node and a highest layer with as many nodes as the number of secondary signals that served as the basis for the compressed signal. Neural network 180 may be trained to decompress received compressed signals into signals that represent the original source signals. For example, neural network 180 as shown in FIG. 4 may be trained to decompress signal c3 into multiple signals d1-dN corresponding to original source signals x1-xN. These representations d1-dN of the original signals may be based on the compressed lossy signal c3, and thus they will not contain the exact same information as original signals x1-xN. Through decompression via neural network 180 incorporating lossless reference signal cSUM, accurate representations of the original source signals may be generated such that sound and speech recognition may be performed.

Figure 7:
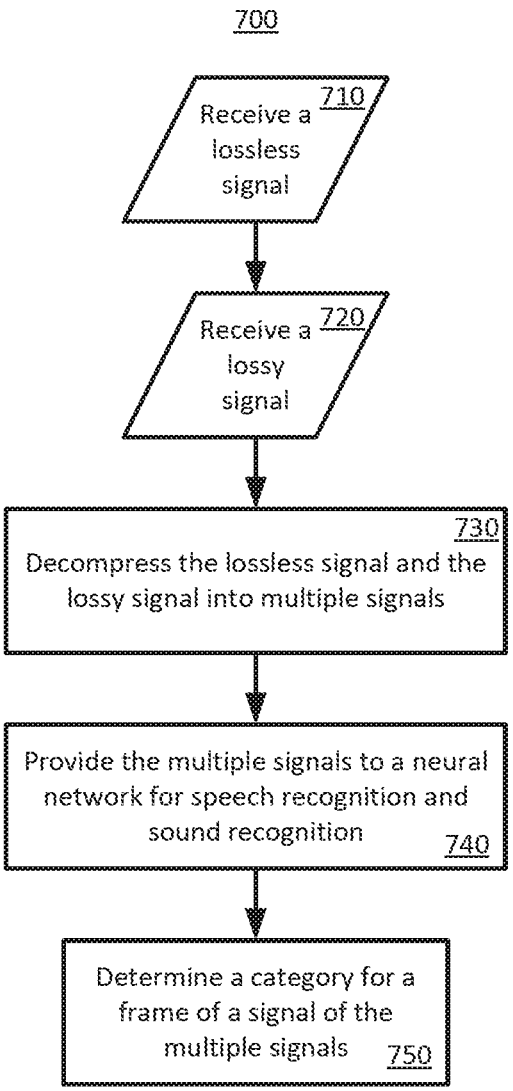
FIG. 7 shows a procedure for decompressing a signal by a neural network according to an implementation of this disclosure.

In an implementation of this disclosure, a computing device may execute a neural network for decompressing received compressed signals. For example, FIG. 7 shows a procedure 700 for decompressing a signal via a neural network. A neural network may receive a compressed or uncompressed lossless reference signal at 710 and a lossy compressed signal at 720. At 730 the neural network may generate multiple output signals, for example d1-dN, from the received lossy compressed signal and lossless reference signal.

Signals output from a decompression neural network, such as signals d1-dN, may be provided to one or more third computing devices executing a third neural network in a cloud computing environment, such as neural network 190 as shown in FIGS. 1 and 4. At 740 the output signals from the decompression neural network may be provided to a third neural network trained for speech and sound recognition. At 750 the third neural network may determine that one or more components, such as frames, of one or more of signals d1-dN is associated with a particular category. For example, the frames may be associated with the category of breaking glass or the category of a known child crying.

In some embodiments the one or more third computing devices executing the third, sound or speech recognition neural network may be local to one or more first computing devices executing the first, compression neural network and/or one or more second computing devices executing the second, decompression neural network. In some implementations the first, second, and/or third neural networks may each be part of the same neural network. The third neural network may include any of the neural network architectures described above, including that of a convolutional, long short-term memory, fully connected deep neural network.

Figure 8:
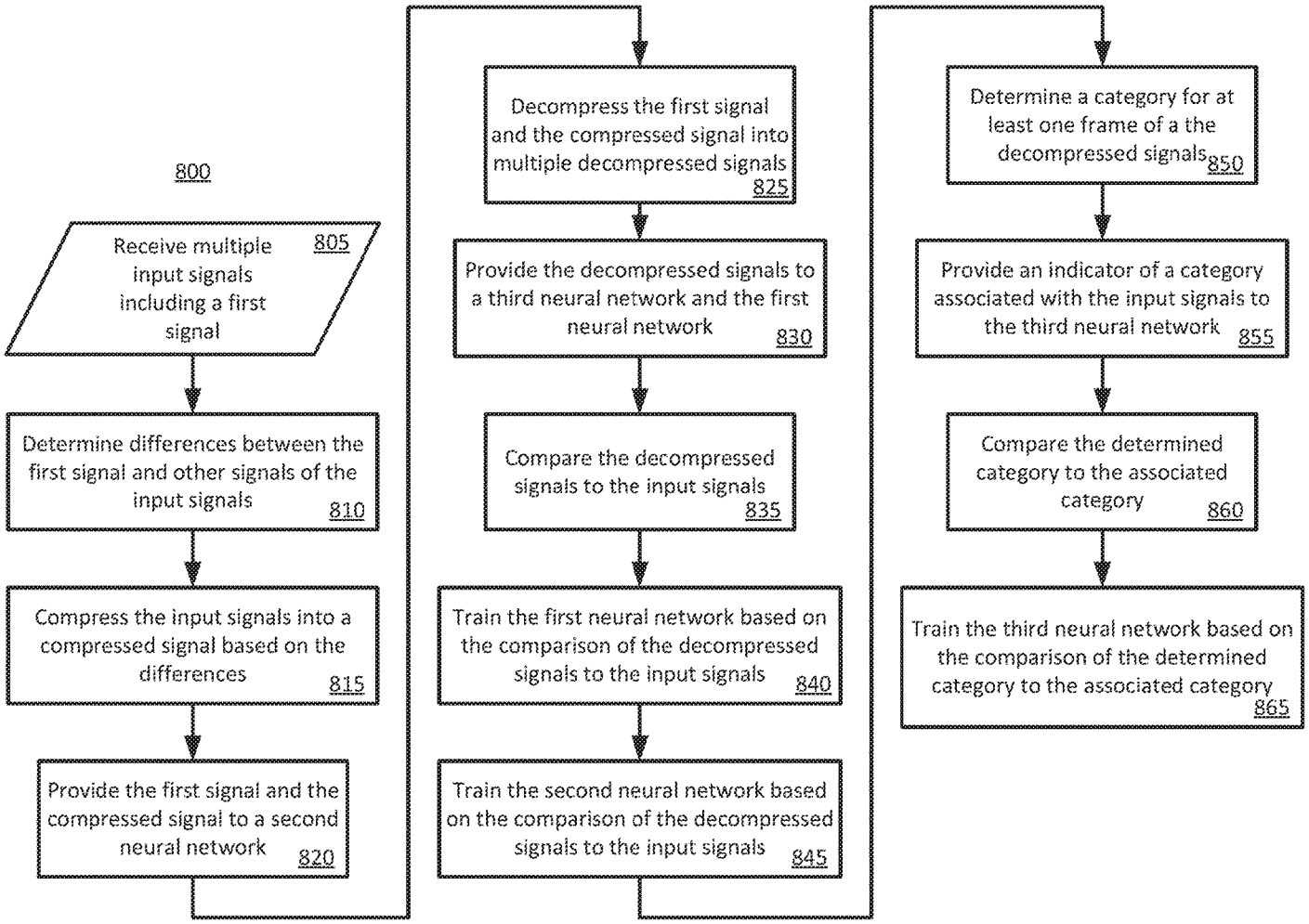
FIG. 8 shows a procedure for training a neural network according to an implementation of this disclosure.

The efficacy of a neural networks for compressing signals, decompressing signals, and recognizing sounds or speech may depend on the method and extent of prior training of the neural networks. FIG. 8 shows a procedure 800 for training neural networks in accordance with an implementation of this disclosure. Generally, the first, second, and/or third neural network may be trained on real signals detected by signal sources on the sensor device or signals that are auralized with respect to the sensor device. At 805 a first neural network executing on one or more first computing devices may receive multiple original audio signals from multiple audio signal sources. The multiple original audio signals may include a first audio signal. At 810 the first neural network may determine multiple signal differences between one or more signal characteristics of the first audio signal and one or more signal characteristics of other audio signals of the multiple original audio signals. At 815 the first neural network may compress the multiple original audio signals into a compressed audio signal based on the multiple signal differences. The one or more first computing devices may then provide the first audio signal and the compressed audio signal to a second neural network executing on one or more second computing devices at 820.

The second neural network may decompress the compressed audio signal into multiple audio signals at 825, and the one or more second computing devices may provide the decompressed audio signals to a third neural network for sound and speech recognition. The one or more second computing devices may also provide the decompressed audio signals back to the first neural network for training purposes at 830. The first neural network may receive the decompressed audio signals from the second neural network.

At 835 the one or more first computing devices may compare the decompressed audio signals to the multiple original audio signals, and at 840, train the first neural network based on the comparison. For example, if a signal characteristic of the decompressed audio signals provides a high quality approximation of a corresponding signal characteristic in the original audio signals, then the weight or other training feature of a node in the first neural network that contributed to inclusion of that signal characteristic in the compressed audio signal may be increased. Similarly, if a signal characteristic of the decompressed audio signals provides a poor quality approximation of a corresponding signal characteristic in the original audio signals, then the weight or other training feature of a node in the first neural network that contributed to inclusion of that signal characteristic in the compressed signal may be decreased. In a similar manner, the one or more second computing devices may train, at 845, the second neural network based on comparison of the decompressed audio signals to the multiple original audio signals. For example, the one or more second computing devices may receive the multiple original audio signals. The one or more second computing devices may compare signal characteristics of the decompressed audio signals to signal characteristics of the multiple original audio signals and adjust the weights or other training features of the nodes of the second neural network accordingly.

The third neural network executing on one or more third computing devices may receive the decompressed signals. At 850, the third neural network may determine a category associated with one or more components, such as a frame, of one or more signals of the decompressed signals. At 855 a computing device executing the first neural network may provide an indicator of a category known to be associated with the multiple original audio signals to the third neural network. At 860 the one or more third computing devices may compare an indicator of the determined category with an indicator of the known category associated with the multiple original audio signals. At 865, the one or more third computing devices may train the third neural network based on this comparison. For example, the weight or other training features of nodes in the third neural network that provided contributions to a successful determination of the known category may be strengthened, while those that provided negative contributions may be weakened.

In some implementations the first neural network and the second neural network may be trained concurrently, while the third neural network is prevented from training, such as by not providing feedback on the success or failure of category determinations by the third neural network. In other implementations, the first, second, and third neural networks may be trained concurrently. Any of a variety of other techniques for training neural networks may be employed in procedure 800, for example supervised, unsupervised, and reinforcement training techniques may be employed.

As discussed throughout this disclosure, operations performed by one or more computing devices executing a neural network may be performed by components of the one or more computing devices other than the neural network or by the neural network executing on the one or more computing devices.

The devices, systems, and procedures set forth in this disclosure may be in communication with other devices, systems, and procedures throughout a premises. Combined these devices, systems, and procedures may make up the greater smart home environment for the premises. Further aspects of the smart home environment and related components are discussed in the following portions of this disclosure.

In general, a "sensor" or "sensor device" as disclosed herein may include multiple sensors or sub-sensors, such as a position sensor that includes both a GPS sensor as well as a wireless network sensor. This combination may provide data that can be correlated with known wireless networks to obtain location information. Multiple sensors may be arranged in a single physical housing, such as where a single device includes movement, temperature, magnetic, and/or other sensors, as well as the devices discussed in earlier portions of this disclosure. Such a housing also may be referred to as a sensor or a sensor device. For clarity, sensors are described with respect to the particular functions they perform and/or the particular physical hardware used, when such specification is necessary for understanding of the embodiments disclosed herein.

Figure 9A:
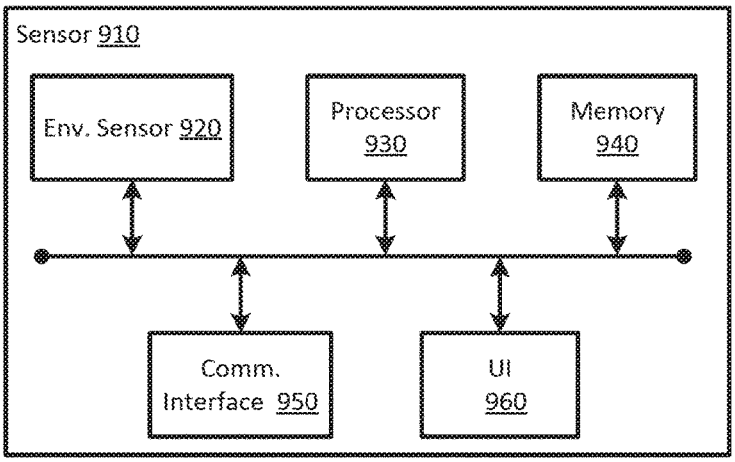
FIG. 9*a* shows a sensor according to an implementation of this disclosure.

A sensor may include hardware in addition to the specific physical sensor that obtains information about the environment. FIG. 9A shows an example sensor as disclosed herein. The sensor 910 may include an environmental sensor 920, such as a temperature sensor, smoke sensor, carbon monoxide sensor, motion sensor, accelerometer, proximity sensor, passive infrared sensor, such as any of the devices discussed in earlier portions of this disclosure, magnetic field sensor, radio frequency (RF) sensor, light sensor, humidity sensor, pressure sensor, microphone, or any other suitable environmental sensor, that obtains a corresponding type of information about the environment in which the sensor 910 is located. A processor 930 may receive and analyze data obtained by the sensor 910, control operation of other components of the sensor 910, and process communication between the sensor and other devices. The processor 930 may execute instructions stored on a computer-readable memory 940. The memory 940 or another memory in the sensor 910 may also store environmental data obtained by the sensor 910. A communication interface 950, such as a Wi-Fi or other wireless interface, Ethernet or other local network interface, or the like may allow for communication by the sensor 910 with other devices. A user interface (UI) 960 may provide information and/or receive input from a user of the sensor. The UI 960 may include, for example, a speaker to output an audible alarm when an event is detected by the sensor 910. Alternatively, or in addition, the UI 960 may include a light to be activated when an event is detected by the sensor 910. The user interface may be relatively minimal, such as a liquid crystal display (LCD), light emitting diode (LED) display, or limited-output display, or it may be a full-featured interface such as a touch-screen. Components within the sensor 910 may transmit and receive information to and from one another via an internal bus or other mechanism as will be readily understood by one of skill in the art. One or more components may be implemented in a single physical arrangement, such as where multiple components are implemented on a single integrated circuit. Sensors as disclosed herein may include other components, and/or may not include all of the illustrative components shown.

Figure 9B:
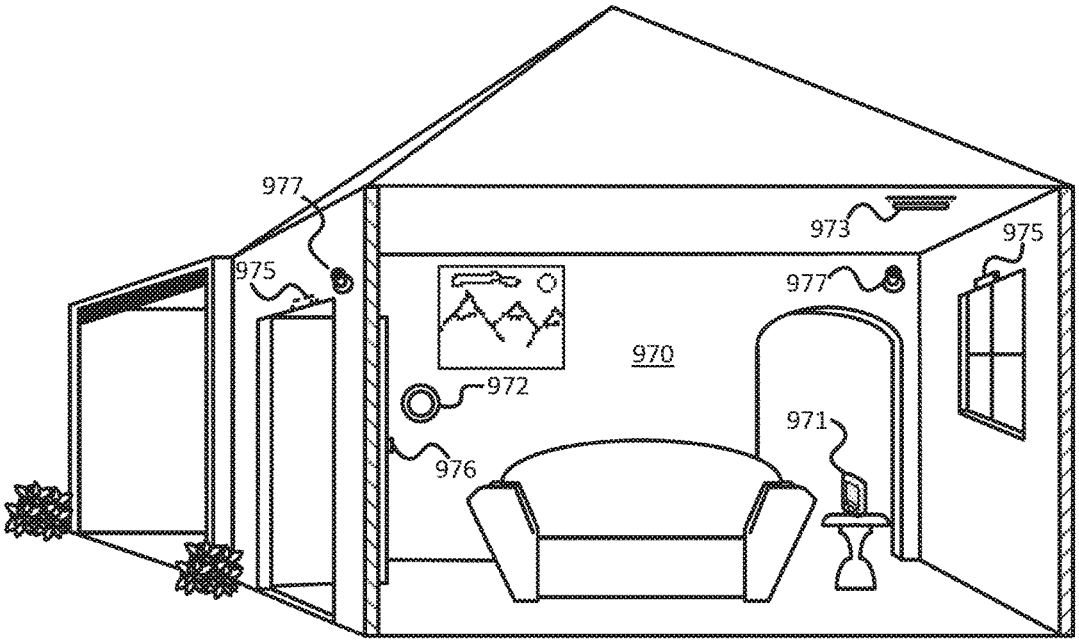
FIG. 9*b* shows a premises according to an implementation of this disclosure.

As an example of the implementation of sensors within a premises FIG. 9B depicts, one or more sensors implemented in a home premises 970 as part of a smart home environment. Mobile device 971, such as a smart phone or tablet, may also be in communication with components of the smart home environment.

In some configurations, two or more sensors may generate data that can be used by a processor of a system to generate a response and/or infer a state of the environment. For example, an ambient light sensor in a room may determine that the room is dark (e.g., less than 60 lux). A microphone in the room may detect a sound above a set threshold, such as 60 dB. The system processor may determine, based on the data generated by both sensors, that it should activate one or more lights in the room. In the event the processor only received data from the ambient light sensor, the system may not have any basis to alter the state of the lighting in the room. Similarly, if the processor only received data from the microphone, the system may lack sufficient data to determine whether activating the lights in the room is necessary, for example, during the day the room may already be bright or during the night the lights may already be on. As another example, two or more sensors may communicate with one another. Thus, data generated by multiple sensors simultaneously or nearly simultaneously may be used to determine a state of an environment and, based on the determined state, generate a response.

Figure 10A:
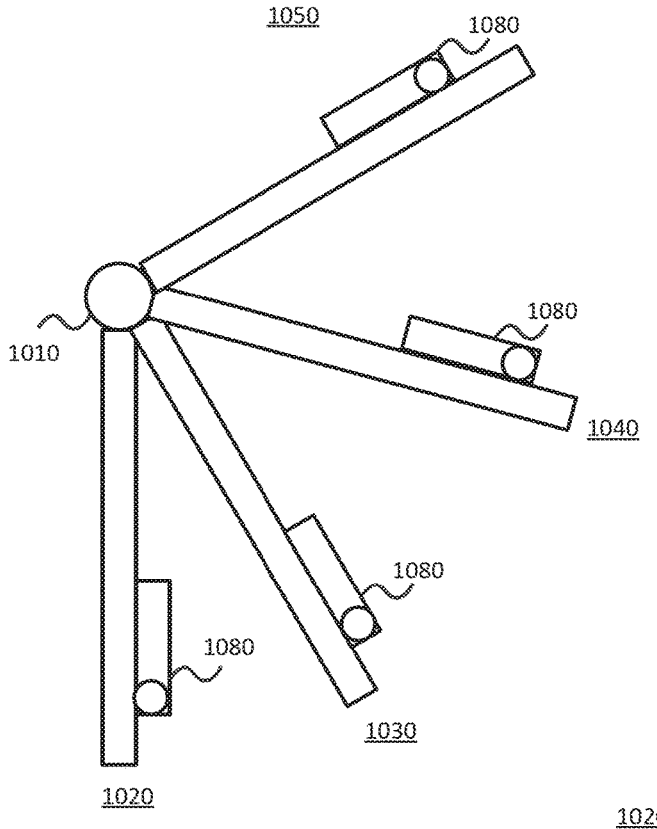
FIG. 10*a* shows a sensor according to an implementation of this disclosure.

As another example, a system may employ a magnetometer affixed to a door jamb and a magnet affixed to the door. When the door is closed, the magnetometer may detect the magnetic field emanating from the magnet. If the door is opened, the increased distance may cause the magnetic field near the magnetometer to be too weak to be detected by the magnetometer. If the system is activated, it may interpret such non-detection as the door being ajar or open. In some configurations, a separate sensor or a sensor integrated into one or more of the magnetometer and/or magnet may be incorporated to provide data regarding the status of the door. For example, an accelerometer and/or a compass may be affixed to the door and indicate the status of the door and/or augment the data provided by the magnetometer. FIG. 10A shows a schematic representation of an example of a door that opens by a hinge mechanism 1010. In the first position 1020, the door is closed and the compass 1080 may indicate a first direction. The door may be opened at a variety of positions as shown 1030, 1040, and 1050. The fourth position 1050 may represent the maximum amount the door can be opened. Based on the compass 1080 readings, the position of the door may be determined and/or distinguished more specifically than merely open or closed. In the second position 1030, for example, the door may not be far enough apart for a person to enter the home. A compass or similar sensor may be used in conjunction with a magnet, such as to more precisely determine a distance from the magnet, or it may be used alone and provide environmental information based on the ambient magnetic field, as with a conventional compass.

Figure 10B:
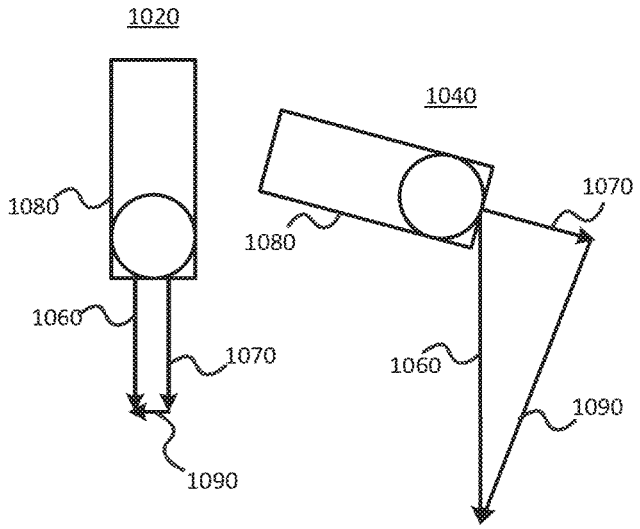
FIG. 10*b* shows a sensor according to an implementation of this disclosure.

FIG. 10B shows a compass 1080 in two different positions, 1020 and 1040, from FIG. 10A. In the first position 1020, the compass detects a first direction 1060. The compass's direction is indicated as 1070, and it may be a known distance from a particular location. For example, when affixed to a door, the compass may automatically determine the distance from the door jamb or a user may input a distance from the door jamb. The distance 1060 representing how far away from the door jamb the door is may be computed by a variety of trigonometric formulas. In the first position 1020, the door is indicated as not being separate from the door jamb (i.e., closed). Although features 1060 and 1070 are shown as distinct in FIG. 10B, they may overlap entirely. In the second position 1040, the distance 1090 between the door jamb and the door may indicate that the door has been opened wide enough that a person may enter. Thus, the sensors may be integrated into a home system, mesh network, or work in combination with other sensors positioned in and/or around an environment.

In some configurations, an accelerometer may be employed to indicate how quickly the door is moving. For example, the door may be lightly moving due to a breeze. This may be contrasted with a rapid movement due to a person swinging the door open. The data generated by the compass, accelerometer, and/or magnetometer may be analyzed and/or provided to a central system such as a controller 1130 and/or remote system 1140 depicted in FIG. 11A. The data may be analyzed to learn a user behavior, an environment state, and/or as a component of a smart home system. While the above example is described in the context of a door, a person having ordinary skill in the art will appreciate the applicability of the disclosed subject matter to other implementations such as a window, garage door, fireplace doors, vehicle windows/doors, faucet positions (e.g., an outdoor spigot), a gate, seating position, other openings, etc.

The data collected from one or more sensors may be used to determine the physical status and/or occupancy status of a premises, for example whether one or more family members are home or away. For example, open/close sensors such as door sensors as described with respect to FIGS. 10A and 10B may be used to determine that an unknown person has entered the premises. The system may first determine that a person has entered the premises due to sensors detecting a door opening and closing in a time span previously determined to be consistent with a person entering or leaving the premises. The system next may identify the person as "unknown" due to the absence of a smartphone, key fob, wearable device, or other device typically used to identify occupants of the premises. Continuing the example, sensor data may be received indicating that a valuable item within the premises has been moved, or that a component of the smart home environment associated with security functions such as a controller disclosed herein, has been moved or damaged. Such sensor data may be received, for example, from a sensor attached to or otherwise associated with the valuable item, from the smart home component itself, or from one or more other sensors within the smart home environment. In response, the system may generate an alert indicating that an unknown person has entered the premises and/or that the item or component has been moved or damaged. The system may further determine that an occupant of the home is close by but not present in the premises, for example based upon a Wi-Fi signal received from the occupant's smartphone, but an absence of near-field or other short-range communication from the same smartphone. In this case, the system may be configured to send the alert to the occupant's smartphone, such as via SMS, email, or other communication. As another example, the system may determine that the premises is already in an "away" state and that no occupants are nearby or expected to return in the near future. In this case, the system may be configured to send the alert to a local law enforcement agency, such as via email, SMS, recorded phone call, or the like.

Data generated by one or more sensors may indicate patterns in the behavior of one or more users and/or an environment state over time, and thus may be used to "learn" such characteristics. For example, sequences of patterns of radiation may be collected by a capture component of a device in a room of a premises and used as a basis to learn object characteristics of a user, pets, furniture, plants, and other objects in the room. These object characteristics may make up a room profile of the room and may be used to make determinations about objects detected in the room.

In another example, data generated by an ambient light sensor in a room of a house and the time of day may be stored in a local or remote storage medium with the permission of an end user. A processor in communication with the storage medium may compute a behavior based on the data generated by the light sensor. The light sensor data may indicate that the amount of light detected increases until an approximate time or time period, such as 3:30 pm, and then declines until another approximate time or time period, such as 5:30 pm, at which point there is an abrupt increase in the amount of light detected. In many cases, the amount of light detected after the second time period may be either below a dark level of light (e.g., under or equal to 60 lux) or bright (e.g., equal to or above 400 lux). In this example, the data may indicate that after 5:30 pm, an occupant is turning on/off a light as the occupant of the room in which the sensor is located enters/leaves the room. At other times, the light sensor data may indicate that no lights are turned on/off in the room. The system, therefore, may learn occupants' patterns of turning on and off lights, and may generate a response to the learned behavior. For example, at 5:30 pm, a smart home environment or other sensor network may automatically activate the lights in the room if it detects an occupant in proximity to the home. In some embodiments, such behavior patterns may be verified using other sensors. Continuing the example, user behavior regarding specific lights may be verified and/or further refined based upon states of, or data gathered by, smart switches, outlets, lamps, and the like.

Such learning behavior may be implemented in accordance with the techniques disclosed herein. For example, a smart home environment as disclosed herein may be configured to learn appropriate notices to generate or other actions to take in response to a determination that a notice should be generated, and/or appropriate recipients of a particular notice or type of notice. As a specific example, a smart home environment may determine that after a notice has been sent to a first occupant of the smart home premises indicating that a window in a room has been left open, a second occupant is always detected in the room within a threshold time period, and the window is closed shortly thereafter. After making such a determination, in future occurrences the notice may be sent to the second occupant or to both occupants for the purposes of improving the efficacy of the notice. In an embodiment, such "learned" behaviors may be reviewed, overridden, modified, or the like by a user of the system, such as via a computer-provided interface to a smart home environment as disclosed herein.

Sensors, premises management systems, mobile devise, and related components as disclosed herein may operate within a communication network, such as a conventional wireless network, and/or a sensor-specific network through which sensors may communicate with one another and/or with dedicated other devices. In some configurations one or more sensors may provide information to one or more other sensors, to a central controller, or to any other device capable of communicating on a network with the one or more sensors. A central controller may be general- or special-purpose. For example, one type of central controller is a home automation network that collects and analyzes data from one or more sensors within the home. Another example of a central controller is a special-purpose controller that is dedicated to a subset of functions, such as a security controller that collects and analyzes sensor data primarily or exclusively as it relates to various security considerations for a location. A central controller may be located locally with respect to the sensors with which it communicates and from which it obtains sensor data, such as in the case where it is positioned within a home that includes a home automation and/or sensor network. Alternatively or in addition, a central controller as disclosed herein may be remote from the sensors, such as where the central controller is implemented as a cloud-based system that communicates with multiple sensors, which may be located at multiple locations and may be local or remote with respect to one another.

Figure 11A:
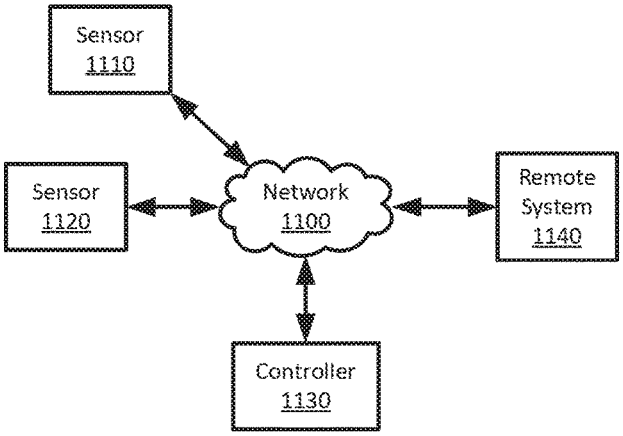
FIG. 11*a* shows networked sensors according to an implementation of this disclosure.
Figure 11B:
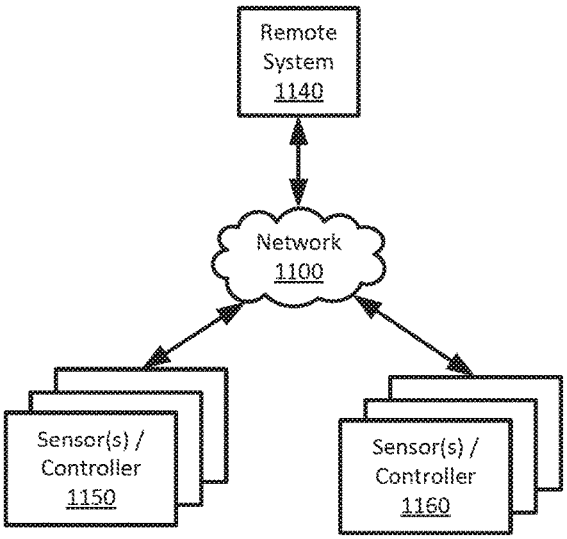
FIG. 11*b* shows networked sensors according to an implementation of this disclosure.

FIG. 11A shows an example of a sensor network as disclosed herein, which may be implemented over any suitable wired and/or wireless communication networks. One or more sensors 1110 and 1120 may communicate via a local network 1100, such as a Wi-Fi or other suitable network, with each other and/or with a controller 1130. The controller may be a general- or special-purpose computer. The controller may, for example, receive, aggregate, and/or analyze environmental information received from the sensors 1110 and 1120. The sensors 1110 and 1120 and the controller 1130 may be located locally to one another, such as within a single dwelling, office space, building, room, or the like, or they may be remote from each other, such as where the controller 1130 is implemented in a remote system 1140 such as a cloud-based reporting and/or analysis system. Alternatively or in addition, sensors may communicate directly with a remote system 1140. The remote system 1140 may, for example, aggregate data from multiple locations, provide instruction, software updates, and/or aggregated data to a controller 1130 and/or sensors 1110, 1120.

The devices of the disclosed subject matter may be communicatively connected via the network 1100, which may be a mesh-type network such as Thread, which provides network architecture and/or protocols for devices to communicate with one another. Typical home networks may have a single device point of communications. Such networks may be prone to failure, such that devices of the network cannot communicate with one another when the single device point does not operate normally. The mesh-type network of Thread, which may be used in methods and systems of the disclosed subject matter may avoid communication using a single device. That is, in the mesh-type network, such as network 1100, there is no single point of communication that may fail so as to prohibit devices coupled to the network from communicating with one another.

The communication and network protocols used by the devices communicatively coupled to the network 1100 may provide secure communications, minimize the amount of power used (i.e., be power efficient), and support a wide variety of devices and/or products in a home, such as appliances, access control, climate control, energy management, lighting, safety, and security. For example, the protocols supported by the network and the devices connected thereto may have an open protocol which may carry IPv6 natively.

The Thread network, such as network 1100, may be easy to set up and secure to use. The network 1100 may use an authentication scheme, such as AES (Advanced Encryption Standard) encryption or the like, to reduce and/or minimize security holes that exist in other wireless protocols. The Thread network may be scalable to connect devices (e.g., 2, 5, 10, 20, 50, 100, 310, 200, or more devices) into a single network supporting multiple hops (e.g., so as to provide communications between devices when one or more nodes of the network is not operating normally). The network 1100, which may be a Thread network, may provide security at the network and application layers. One or more devices communicatively coupled to the network 1100 (e.g., controller 1130, remote system 1140, and the like) may store product install codes to ensure only authorized devices can join the network 1100. One or more operations and communications of network 1100 may use cryptography, such as public-key cryptography.

The devices communicatively coupled to the network 1100 of the smart home environment disclosed herein may have low power consumption and/or reduced power consumption. That is, devices efficiently communicate to with one another and operate to provide functionality to the user, where the devices may have reduced battery size and increased battery lifetimes over conventional devices. The devices may include sleep modes to increase battery life and reduce power requirements. For example, communications between devices coupled to the network 1100 may use the power-efficient IEEE 802.15.4 MAC/PHY protocol. In embodiments of the disclosed subject matter, short messaging between devices on the network 1100 may conserve bandwidth and power. The routing protocol of the network 1100 may reduce network overhead and latency. The communication interfaces of the devices coupled to the smart home environment may include wireless system-on-chips to support the low-power, secure, stable, and/or scalable communications network 1100.

The sensor network shown in FIG. 11A may be an example of a smart home environment. The depicted smart home environment may include a structure, a house, office building, garage, mobile home, or the like. The devices of the smart home environment, such as the sensors 1110 and 1120 the controller 1130, and the network 1100 may be integrated into a smart home environment that does not include an entire structure, such as an apartment, condominium, or office space.

The smart home environment can control and/or be coupled to devices outside of the structure. For example, one or more of the sensors 1110 and 1120 may be located outside the structure, for example, at one or more distances from the structure (e.g., sensors 1110 and 1120 may be disposed outside the structure, at points along a land perimeter on which the structure is located, and the like. One or more of the devices in the smart home environment need not physically be within the structure. For example, the controller 1130 which may receive input from the sensors 1110 and 1120 may be located outside of the structure.

The structure of the smart home environment may include a plurality of rooms, separated at least partly from each other via walls. The walls can include interior walls or exterior walls. Each room can further include a floor and a ceiling. Devices of the smart home environment, such as the sensors 1110 and 1120, may be mounted on, integrated with and/or supported by a wall, floor, or ceiling of the structure.

The smart home environment including the sensor network shown in FIG. 11A may include a plurality of devices, including intelligent, multi-sensing, network-connected devices, that can integrate seamlessly with each other and/or with a central server or a cloud-computing system (e.g., controller 1130 and/or remote system 1140) to provide home-security and smart home features. The smart home environment may include one or more intelligent, multi-sensing, network-connected thermostats (e.g., "smart thermostats"), one or more intelligent, network-connected, multi-sensing hazard detection units (e.g., "smart hazard detectors"), and one or more intelligent, multi-sensing, network-connected entryway interface devices (e.g., "smart doorbells"). The smart hazard detectors, smart thermostats, and smart doorbells may be the sensors 1110 and 1120 shown in FIG. 11A.

For example, a smart thermostat may detect ambient climate characteristics (e.g., temperature and/or humidity) and may accordingly control an HVAC system of the structure. For example, the ambient climate characteristics may be detected by sensors 1110 and 1120 shown in FIG. 11A, and the controller 1130 may control the HVAC system (not shown) of the structure.

As another example, a smart hazard detector may detect the presence of a hazardous substance or a substance indicative of a hazardous substance (e.g., smoke, fire, or carbon monoxide). For example, smoke, fire, and/or carbon monoxide may be detected by sensors 1110 and 1120 shown in FIG. 11A, and the controller 1130 may control an alarm system to provide a visual and/or audible alarm to the user of the smart home environment.

As another example, a smart doorbell may control doorbell functionality, detect a person's approach to or departure from a location (e.g., an outer door to the structure), and announce a person's approach or departure from the structure via audible and/or visual message that is output by a speaker and/or a display coupled to, for example, the controller 1130.

In some embodiments, the smart home environment of the sensor network shown in FIG. 11A may include one or more intelligent, multi-sensing, network-connected wall switches (e.g., "smart wall switches"), one or more intelligent, multi-sensing, network-connected wall plug interfaces (e.g., "smart wall plugs"). The smart wall switches and/or smart wall plugs may be or include one or more of the sensors 1110 and 1120 shown in FIG. 11A. A smart wall switch may detect ambient lighting conditions, and control a power and/or dim state of one or more lights. For example, a sensor such as sensors 1110 and 1120, may detect ambient lighting conditions, and a device such as the controller 1130 may control the power to one or more lights (not shown) in the smart home environment. Smart wall switches may also control a power state or speed of a fan, such as a ceiling fan. For example, sensors 1110 and 1120 may detect the power and/or speed of a fan, and the controller 1130 may adjust the power and/or speed of the fan, accordingly. Smart wall plugs may control supply of power to one or more wall plugs (e.g., such that power is not supplied to the plug if nobody is detected to be within the smart home environment). For example, one of the smart wall plugs may control supply of power to a lamp (not shown).

In embodiments of the disclosed subject matter, a smart home environment may include one or more intelligent, multi-sensing, network-connected entry detectors (e.g., "smart entry detectors"). Such detectors may be or include one or more of the sensors 1110 and 1120 shown in FIG. 11A. The illustrated smart entry detectors (e.g., sensors 1110 and 1120) may be disposed at one or more windows, doors, and other entry points of the smart home environment for detecting when a window, door, or other entry point is opened, broken, breached, and/or compromised. The smart entry detectors may generate a corresponding signal to be provided to the controller 1130 and/or the remote system 1140 when a window or door is opened, closed, breached, and/or compromised. In some embodiments of the disclosed subject matter, the alarm system, which may be included with controller 1130 and/or coupled to the network 1100 may not arm unless all smart entry detectors (e.g., sensors 1110 and 1120) indicate that all doors, windows, entryways, and the like are closed and/or that all smart entry detectors are armed.

The smart home environment of the sensor network shown in FIG. 11A can include one or more intelligent, multi-sensing, network-connected doorknobs (e.g., "smart doorknob"). For example, the sensors 1110 and 1120 may be coupled to a doorknob of a door (e.g., doorknobs located on external doors of the structure of the smart home environment). However, it should be appreciated that smart doorknobs can be provided on external and/or internal doors of the smart home environment.

The smart thermostats, the smart hazard detectors, the smart doorbells, the smart wall switches, the smart wall plugs, the smart entry detectors, the smart doorknobs, the keypads, and other devices of a smart home environment (e.g., as illustrated as sensors 1110 and 1120 of FIG. 11A) can be communicatively coupled to each other via the network 1100, and to the controller 1130 and/or remote system 1140 to provide security, safety, and/or comfort for the smart home environment. Alternatively or in addition, each of the devices of the smart home environment may provide data that can be used to determine an occupancy and/or physical status of a premises, as well as data that may be used to determine an appropriate recipient of a notification, as previously disclosed herein.

A user can interact with one or more of the network-connected smart devices (e.g., via the network 1100). For example, a user can communicate with one or more of the network-connected smart devices using a computer or mobile device (e.g., a desktop computer, laptop computer, tablet, or the like) or other portable electronic device (e.g., a smartphone, a tablet, a key FOB, or the like). A webpage or application can be configured to receive communications from the user and control the one or more of the network-connected smart devices based on the communications and/or to present information about the device's operation to the user. For example, the user can view, arm or disarm the security system of the home.

One or more users can control one or more of the network-connected smart devices in the smart home environment using a network-connected computer or portable electronic device. In some examples, some or all of the users (e.g., individuals who live in the home) can register their mobile device and/or key FOBs with the smart home environment (e.g., with the controller 1130). Such registration can be made at a central server (e.g., the controller 1130 and/or the remote system 1140) to authenticate the user and/or the electronic device as being associated with the smart home environment, and to provide permission to the user to use the electronic device to control the network-connected smart devices and systems of the smart home environment. A user can use their registered electronic device to remotely control the network-connected smart devices and systems of the smart home environment, such as when the occupant is at work or on vacation. The user may also use their registered electronic device to control the network-connected smart devices when the user is located inside the smart home environment.

Alternatively, or in addition to registering electronic devices, the smart home environment may make inferences about which individuals live in the home (occupants) and are therefore users and which electronic devices are associated with those individuals. As such, the smart home environment may "learn" who is a user (e.g., an authorized user) and permit the electronic devices associated with those individuals to control the network-connected smart devices of the smart home environment (e.g., devices communicatively coupled to the network 1100) in some embodiments, including sensors used by or within the smart home environment. Various types of notices and other information may be provided to users via messages sent to one or more user electronic devices. For example, the messages can be sent via email, short message service (SMS), multimedia messaging service (MMS), unstructured supplementary service data (USSD), as well as any other type of messaging services and/or communication protocols. As previously described, such notices may be generated in response to specific determinations of the occupancy and/or physical status of a premises, or they may be sent for other reasons as disclosed herein.

A smart home environment may include communication with devices outside of the smart home environment but within a proximate geographical range of the home. For example, the smart home environment may include an outdoor lighting system (not shown) that communicates information through the communication network 1100 or directly to a central server or cloud-computing system (e.g., controller 1130 and/or remote system 1140) regarding detected movement and/or presence of people, animals, and any other objects and receives back commands for controlling the lighting accordingly.

The controller 1130 and/or remote system 1140 can control the outdoor lighting system based on information received from the other network-connected smart devices in the smart home environment. For example, in the event that any of the network-connected smart devices, such as smart wall plugs located outdoors, detect movement at nighttime, the controller 1130 and/or remote system 1140 can activate the outdoor lighting system and/or other lights in the smart home environment.

In some configurations, a remote system 1140 may aggregate data from multiple locations, such as multiple buildings, multi-resident buildings, individual residences within a neighborhood, multiple neighborhoods, and the like. In general, multiple sensor/controller systems 1150 and 1160 as shown FIG. 11B may provide information to the remote system 1140. The systems 1150 and 1160 may provide data directly from one or more sensors as previously described, or the data may be aggregated and/or analyzed by local controllers such as the controller 1130, which then communicates with the remote system 1140. The remote system may aggregate and analyze the data from multiple locations, and may provide aggregate results to each location. For example, the remote system 1140 may examine larger regions for common sensor data or trends in sensor data, and provide information on the identified commonality or environmental data trends to each local system 1150 and 1160. Aggregated data may be used to generate appropriate notices and/or determine appropriate recipients for such notices as disclosed herein. For example, the remote system 1140 may determine that the most common user response to a notification that a garage door has been left open while a security component of the smart home environment is in an armed state, is that the user returns to the premises and closes the garage door. Individual smart home systems and/or controllers as previously disclosed may receive such data from the remote system and, in response, set a default action of closing the garage door when the system determines that an armed state has been set and the garage door has been left open for more than a minimum threshold of time. The data provided to the individual systems may be only aggregate data, i.e., such that no individual information about any one other smart home environment or type of smart home environment is provided to any other. As another example, the remote system may receive data from multiple premises in a particular geographic region, indicating that it is raining in the region, and that the rain is moving east (based on the times at which the data indicating rainfall is received from different premises). In response, the remote system may provide an indication to premises further to the east that rain may be expected. In response, notifications may be provided to occupants of the individual premises that rain is expected, that particular windows should be closed, or the like. In some configurations users may be provided with the option of receiving such aggregated data, and/or with the option of providing anonymous data to a remote system for use in such aggregation. In some configurations, aggregated data also may be provided as "historical" data as previously disclosed. Such data may be used by a remote system and/or by individual smart home environments to identify trends, predict physical statuses of a premises, and the like.

In situations in which the systems discussed here collect personal information about users, or may make use of personal information, the users may be provided with an opportunity to control whether programs or features collect user information (e.g., information about a user's social network, social actions or activities, profession, a user's preferences, or a user's current location), or to control whether and/or how to receive content from the content server that may be more relevant to the user. In addition, certain data may be treated in one or more ways before it is stored or used, so that personally identifiable information is removed. For example, specific information about a user's residence may be treated so that no personally identifiable information can be determined for the user, or a user's geographic location may be generalized where location information is obtained (such as to a city, ZIP code, or state level), so that a particular location of a user cannot be determined. As another example, systems disclosed herein may allow a user to restrict the information collected by those systems to applications specific to the user, such as by disabling or limiting the extent to which such information is aggregated or used in analysis with other information from other users. Thus, the user may have control over how information is collected about the user and used by a system as disclosed herein.

Figure 12:
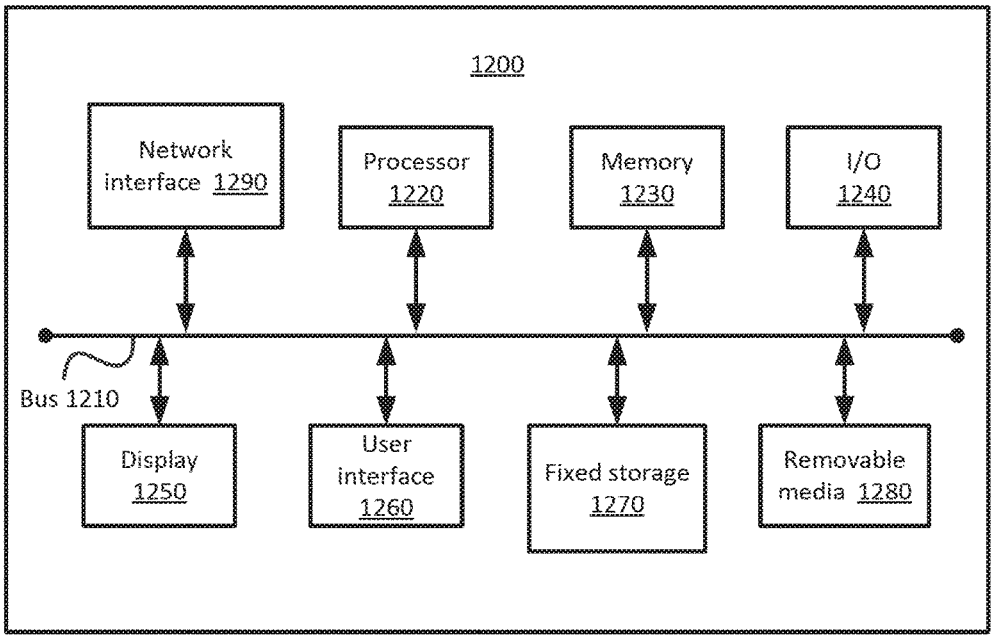
FIG. 12 shows a computing device according to an implementation of this disclosure.

Embodiments of the presently disclosed subject matter may be implemented in and used with a variety of computing devices. FIG. 12 is an example of a computing device 1200 suitable for implementing embodiments of the disclosed subject matter. For example, the computing device 1200 may be used to implement a controller, a premises management system, a device including sensors as disclosed herein, or the like. Alternatively or in addition, the device 1200 may be, for example, a desktop or laptop computer, or a mobile computing device such as a smart phone, tablet, or the like. Computing device 1200 may include a bus 1210 which interconnects major components of the computing device 1200, such as a central processor 1220, memory 1230 such as Random Access Memory (RAM), Read Only Memory (ROM), flash RAM, or the like, a user display 1250 such as a display screen, a user interface 1260, which may include one or more controllers and associated user input devices such as a keyboard, mouse, touch screen, and the like, a fixed storage 1270 such as a hard drive, flash storage, and the like, a removable media component 1280 operative to control and receive an optical disk, flash drive, and the like, and a network interface 1290 operable to communicate with one or more remote devices via a suitable network connection.

The bus 1210 allows data communication between the central processor 1220 and one or more memory components 1230 and 1270, which may include RAM, ROM, and other memory, as previously noted. Applications resident with the computing device 1200 are generally stored on and accessed via a non-transitory, computer-readable storage medium, such as memory 1230 or fixed storage 1270.

The fixed storage 1270 may be integral with the computing device 1200 or may be separate and accessed through other interfaces. The network interface 1290 may provide a direct connection to a remote server via a wired or wireless connection. The network interface 1290 may provide such connection using any suitable technique and protocol as will be readily understood by one of skill in the art, including digital cellular telephone, Wi-Fi, Bluetooth®, near-field, and the like. For example, the network interface 1290 may allow the device to communicate with other computers via one or more local, wide-area, or other communication networks, as described in further detail herein.

Figure 13:
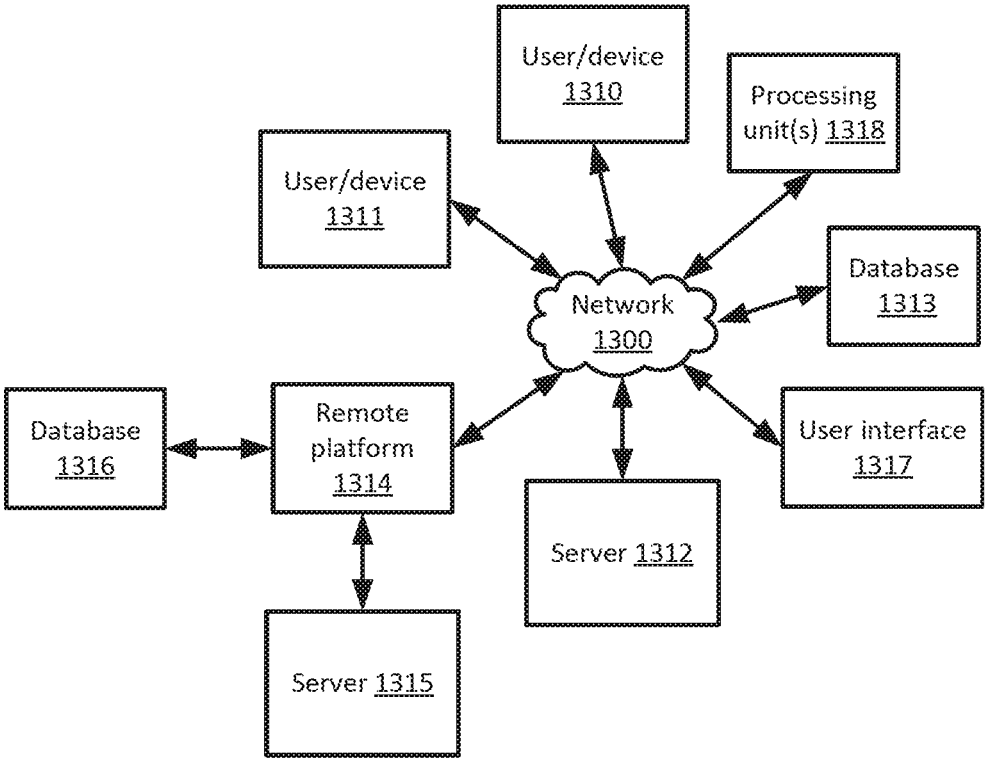
FIG. 13 shows a networked arrangement according to an implementation of this disclosure.

FIG. 13 shows an example network arrangement 1300 according to an embodiment of the disclosed subject matter. One or more devices 1310, 1311, such as local computers, smart phones, tablet computing devices, or sensors such as that described above with respect to FIGS. 9A and 9B, and the like may connect to other devices via one or more networks 1300. Each device may be a computing device or in communication with a computing device as previously described. The network 1300 may be a local network, wide-area network, the Internet, or any other suitable communication network or networks, and may be implemented on any suitable infrastructure, including wired and/or wireless networks. The devices may communicate with one or more remote systems, such as servers 1312, 1315 and/or databases 1313, 1316 implemented on computing devices. Remote systems may be directly accessible by the devices 1310, 1311. For example, processing units 1318 may provide cloud-scale processing and data analytics, such as neural network analysis for providing sound and image recognition services. In other embodiments, one or more other devices may provide intermediary access such as where remote platform 1314 provides access to resources stored in a database 1316 or cloud computing services and/or storage services from server 1315. Remote systems may provide additional functionality to devices 1310, 1311, such as user interface functionality 1317.

Various embodiments of the presently disclosed subject matter may include or be embodied in the form of computer-implemented processes and apparatuses for practicing those processes. Embodiments also may be embodied in the form of a computer program product having computer program code containing instructions embodied in non-transitory and/or tangible media, such as hard drives, USB (universal serial bus) drives, or any other machine readable storage medium, such that when the computer program code is loaded into and executed by a computer, the computer becomes an apparatus for practicing embodiments of the disclosed subject matter. When implemented on a general-purpose microprocessor, the computer program code may configure the microprocessor to become a special-purpose device, such as by creation of specific logic circuits as specified by the instructions.

Embodiments may be implemented using hardware that may include a processor, such as a general purpose microprocessor and/or an Application Specific Integrated Circuit (ASIC) that embodies all or part of the techniques according to embodiments of the disclosed subject matter in hardware and/or firmware. The processor may be coupled to memory, such as RAM, ROM, flash memory, a hard disk or any other device capable of storing electronic information. The memory may store instructions adapted to be executed by the processor to perform the techniques according to embodiments of the disclosed subject matter.

The foregoing description, for purpose of explanation, has been described with reference to specific embodiments. However, the illustrative discussions above are not intended to be exhaustive or to limit embodiments of the disclosed subject matter to the precise forms disclosed. Many modifications and variations are possible in view of the above teachings. The embodiments were chosen and described in order to explain the principles of embodiments of the disclosed subject matter and their practical applications, to thereby enable others skilled in the art to utilize those embodiments as well as various embodiments with various modifications as may be suited to the particular use contemplated.

The invention claimed is:

1. A method comprising:

receiving, at a decompression neural network, a lossless reference signal and a lossy compressed signal;

generating, at the decompression neural network, a plurality of output signals from the received lossy compressed signal and lossless reference signal;

providing the output signals from the decompression neural network to a neural network for speech and sound recognition; and determining, at the neural network for speech recognition and sound recognition, that one or more components of at least one of the plurality of output signals are associated with a particular category of physical events, wherein the neural network for speech recognition and sound recognition, a compression neural network that transmits the lossless reference signal and the lossy compressed signal, and the decompression neural network are each part of the same neural network.

2. The method of claim 1, wherein the generating the plurality of output signals comprises:

decompressing the lossless reference signal and the lossy compressed signal into the plurality of output signals.

3. The method of claim 1, wherein the neural network for speech recognition and sound recognition is local to at least one of the group consisting of: one or more first computing devices executing a compression neural network and one or more second computing devices executing the decompression neural network.

4. The method of claim 3, wherein the decompression neural network receives the lossless reference signal and the lossy compressed signal from the one or more first computing devices executing the compression neural network.

5. The method of claim 1, wherein the neural network for speech recognition and sound recognition is selected from at least one from the group consisting of: a convolutional neural network, a long short-term memory neural network, and a fully connected deep neural network.

6. A system comprising:

a decompression neural network to receive a lossless reference signal and a lossy compressed signal, and to generate a plurality of output signals from the received lossy compressed signal and lossless reference signal;

a neural network for speech and sound recognition to receive the output signals from the decompression neural network and to determine that one or more components of at least one of the plurality of output signals are associated with a particular category of physical events; and a compression neural network that transmits the lossless reference signal and the lossy compressed signal, wherein the neural network for speech recognition and sound recognition, the compression neural network, and the decompression neural network are each part of the same neural network.

7. The system of claim 6, wherein the decompression neural network generates the plurality of output signals by decompressing the lossless reference signal and the lossy compressed signal into the plurality of output signals.

8. The system of claim 6, wherein the neural network for speech recognition and sound recognition is local to at least one of the group consisting of: one or more first computing devices executing a compression neural network and one or more second computing devices executing the decompression neural network.

9. The system of claim 8, wherein the decompression neural network receives the lossless reference signal and the lossy compressed signal from the one or more first computing devices executing the compression neural network.

10. The system of claim 6, wherein the neural network for speech recognition and sound recognition is selected from at least one from the group consisting of: a convolutional neural network, a long short-term memory neural network, and a fully connected deep neural network.

* * * * *